US011149491B1

(12) United States Patent
Ulsh et al.

(10) Patent No.: US 11,149,491 B1
(45) Date of Patent: Oct. 19, 2021

(54) SCREEN FRAME AND ADAPTER FOR UNIVERSAL INSTALLATION WITHIN DIFFERENT SIZED WINDOW/DOOR SOCKETS

(71) Applicants: Steven D. Ulsh, Elizabethville, PA (US); John C. St. Clair, Ashville, PA (US)

(72) Inventors: Steven D. Ulsh, Elizabethville, PA (US); John C. St. Clair, Ashville, PA (US)

( * ) Notice: Subject to any disclaimer, the term of this patent is extended or adjusted under 35 U.S.C. 154(b) by 0 days.

(21) Appl. No.: 16/708,774

(22) Filed: Dec. 10, 2019

Related U.S. Application Data

(60) Provisional application No. 62/777,355, filed on Dec. 10, 2018.

(51) Int. Cl.
*E06B 9/52* (2006.01)
*E06B 3/96* (2006.01)

(52) U.S. Cl.
CPC ..... *E06B 9/52* (2013.01); *E06B 3/96* (2013.01); *E06B 2009/527* (2013.01)

(58) Field of Classification Search
CPC .... E06B 9/52; E06B 2009/527; E06B 1/6046; E06B 1/6053; E06B 1/6061; E06B 1/60; E06B 1/6084; E06B 1/6069; E06B 1/34; E06B 3/96
USPC ..... 52/204.56, 504.595, 211, 213, 215, 216, 52/217, 202, 204.2, 204.591, 204.595
See application file for complete search history.

(56) References Cited

U.S. PATENT DOCUMENTS

| | | | |
|---|---|---|---|
| 78,541 | A | 7/1868 | McCluskey |
| 246,153 | A | 8/1881 | Koch |
| 266,246 | A | 11/1882 | Willer |
| 268,491 | A | 12/1882 | Hubbeil |
| 514,654 | A | 2/1894 | Higgin |
| 690,662 | A | 1/1902 | Perrin |
| 724,682 | A | 4/1903 | Eastman |
| 792,833 | A | 6/1905 | Lee |

(Continued)

OTHER PUBLICATIONS

Press Fit Forces Stress Design Calculator, Jun. 18, 2018, available at: www.engineersedge.com/calculators/machine-design/press-fit/press-fit.htm.

(Continued)

*Primary Examiner* — Brent W Herring
(74) *Attorney, Agent, or Firm* — Thomas A. O'Rourke; Bodner & O'Rourke, LLP

(57) ABSTRACT

A particularly formed frame and corresponding adapters permit installation of a screen assembly into different windows or doors having different socket widths, reducing the required number of SKUs that need to be stocked. The adapter includes: a base portion; a stem portion; and a bulb portion. The frame includes a plurality of recesses, each configured to slidably receive an adapter therein. The width of the frame is sized to be received in a first door/window socket having a first socket width. When a first sized adapter having a first bulb size is installed in each recess, the width of the frame and the protruding distance of the first bulb size are configured to be received in a second door/window socket having a second socket width. A second sized adapter having a second bulb size may instead be installed for use in a second door/window socket having a second socket width.

12 Claims, 5 Drawing Sheets

(56) References Cited

U.S. PATENT DOCUMENTS 1,010,700 A 12/1911 Steger
1,025,256 A 5/1912 Faber
1,038,367 A 9/1912 Henry
1,042,380 A 10/1912 Baker
1,047,828 A 12/1912 Morgner
1,058,616 A 4/1913 Maze
1,135,352 A 4/1915 Bunger
1,178,219 A 4/1916 Gramer
1,187,402 A 6/1916 Traut
1,260,589 A 3/1918 Steger
1,423,021 A 7/1922 Reynolds
1,436,858 A 11/1922 Burhen
1,653,184 A 12/1927 Kolumbus
1,678,941 A 7/1928 Helman
1,697,768 A 1/1929 King
1,733,877 A 10/1929 Higgin
1,736,688 A 11/1929 Yerby
1,745,818 A 2/1930 Trombly
1,760,612 A 5/1930 Trott
1,794,956 A 3/1931 Heath
1,807,425 A 5/1931 McCalmon
1,824,897 A 9/1931 Johnson
1,856,323 A 5/1932 Feaster
1,879,377 A 9/1932 McNeely
1,947,307 A 2/1934 Rafton
1,959,136 A 5/1934 Miller
1,977,165 A 10/1934 Williams
1,997,713 A 4/1935 Boehm
1,997,740 A 4/1935 Nickerson
2,052,467 A 8/1936 Hermann
2,079,718 A 5/1937 Sgritta
2,082,513 A 6/1937 Roberts
2,126,544 A 8/1938 Evethard
2,204,761 A 3/1939 Lang
2,197,489 A 4/1940 Trulock
2,265,375 A 12/1941 Julien
2,274,700 A 3/1942 Jenks
2,297,729 A 10/1942 Thomas
2,444,288 A 6/1948 Gilson
2,511,239 A 6/1950 Behnke
2,523,383 A 9/1950 Maikrzak
2,532,886 A 12/1950 Bianchi
2,537,109 A 1/1951 Willett
2,598,770 A 6/1952 Drozt
2,612,947 A 10/1952 Jenks
2,619,168 A 11/1952 Leverence
2,625,217 A 1/1953 Spiller
2,670,079 A 2/1954 Betts
2,695,664 A 11/1954 Delegard
2,702,596 A 2/1955 Morrow
2,720,950 A 10/1955 Rick
2,722,978 A 11/1955 Frisk
2,723,032 A 11/1955 Gisler
2,759,538 A 8/1956 Long
2,774,477 A 12/1956 Pollitz
2,797,750 A 7/1957 Van Dette
2,835,325 A 5/1958 Gilbert
2,848,762 A * 8/1958 Peterson ..... E06B 3/60 52/127.6
2,897,889 A 8/1959 Kessler
2,902,165 A 9/1959 Imershein
2,914,123 A 11/1959 Deuble
2,989,788 A 6/1961 Kessler
3,002,557 A 10/1961 Roth
3,016,993 A * 1/1962 Owen ..... E06B 1/045 52/204.591
3,057,401 A 10/1962 Gomory
3,107,991 A 10/1963 Taussig
3,176,843 A 4/1965 Hoskins
3,220,469 A 11/1965 Oehmig
3,255,810 A 6/1966 Rowbattam
3,276,513 A 10/1966 Lemelson
3,321,885 A 5/1967 Pratt
3,341,013 A 9/1967 Moulton
3,374,597 A 3/1968 Whitener
3,442,059 A * 5/1969 Kessler ..... E06B 3/62 52/204.595
3,455,367 A 7/1969 Tarte
3,477,574 A 11/1969 Malfroy
3,679,057 A 7/1972 Perez
3,716,138 A 2/1973 Lumsden
3,760,860 A 9/1973 Kelarakis
4,015,394 A * 4/1977 Kessler ..... E06B 3/6621 52/786.1
4,033,865 A 7/1977 Derrick
4,125,976 A * 11/1978 Carlsson ..... B60J 1/10 52/217
4,232,310 A 11/1980 Wilson
4,311,183 A 1/1982 Herbst
4,472,914 A * 9/1984 DeBoef ..... E06B 3/28 52/202
4,502,260 A 3/1985 Machler
4,568,455 A 2/1986 Huber
4,570,406 A 2/1986 DiFazio
4,599,833 A * 7/1986 Bullock ..... E06B 3/5842 52/127.5
4,702,051 A * 10/1987 Miller ..... E06B 3/28 403/402
4,841,696 A * 6/1989 Miller ..... E06B 3/28 403/402
4,888,924 A * 12/1989 Grisham ..... E06B 1/18 52/217
4,968,366 A 11/1990 Hukki
5,032,210 A 7/1991 Hukki
5,039,246 A 8/1991 Woodruff
5,046,546 A 9/1991 Benedyk
5,090,469 A 2/1992 Boulanger
5,097,886 A * 3/1992 Moyet-Ortiz ..... E06B 9/521 160/368.1
5,137,622 A 8/1992 Souter
5,469,906 A 11/1995 Cason
5,540,019 A 7/1996 Beske
5,547,011 A 8/1996 Dotson
5,594,418 A 1/1997 Martin
5,666,773 A 9/1997 Librande
5,718,791 A 2/1998 Spengler
5,732,760 A * 3/1998 Pattison ..... E06B 3/28 160/371
5,737,885 A * 4/1998 Stoyke ..... E06B 3/28 52/202
5,775,400 A 7/1998 Wilkinson
5,787,657 A 8/1998 Librande
5,794,325 A 8/1998 Simone
5,794,528 A 8/1998 Gronig
5,797,223 A 8/1998 Shoup
5,851,393 A 12/1998 Carr
6,073,675 A 6/2000 Dannaher
6,108,997 A 8/2000 Blais
6,276,426 B1 8/2001 Polak
6,279,644 B1 8/2001 Wylie
6,331,223 B1 12/2001 Wylie
6,450,345 B1 9/2002 Adams
6,565,698 B1 5/2003 Adams
6,669,985 B2 12/2003 Adams
6,736,270 B2 5/2004 Adams
6,742,565 B2 6/2004 Badley
6,977,021 B2 12/2005 Annacchino
6,991,693 B2 1/2006 Wylie
7,007,735 B1 3/2006 Lake
7,740,048 B2 6/2010 Wilson
7,861,473 B1 1/2011 Green
8,042,598 B2 10/2011 Bredemus
8,056,602 B1 11/2011 Green
8,191,606 B2 6/2012 Edlin
8,919,826 B2 12/2014 Small
D727,539 S 4/2015 Alexander
9,157,271 B2 10/2015 Burton
9,234,388 B2 1/2016 Altieri
D748,818 S 2/2016 Shen
D757,299 S 5/2016 Altieri
9,631,417 B2 4/2017 Massey
2004/0140067 A1 7/2004 Kelley
2005/0056389 A1 3/2005 Kelley

(56) References Cited

U.S. PATENT DOCUMENTS

| | | | | |
|---|---|---|---|---|
| 2006/0048467 | A1 | 3/2006 | Martineau | |
| 2006/0054286 | A1 | 3/2006 | Woodward | |
| 2006/0231221 | A1 | 10/2006 | Chen | |
| 2014/0290160 | A1 | 10/2014 | Altieri | |
| 2014/0290880 | A1 | 10/2014 | Altieri | |
| 2017/0234059 | A1* | 8/2017 | Chancerel | E06B 5/025 49/466 |
| 2020/0291717 | A1* | 9/2020 | Bernhagen | E06B 1/6007 |

OTHER PUBLICATIONS

"Three General Types of Fit," available at www.mmto.org/dclark/Reports/Encoder%20Upgrade/fittolerences%20%5BRead-Only%5D.pdf., Jul. 8, 2019.

"Engineering Fit," available at: https://en.wikipedia.org/wiki/Engineering_fit, Jul. 8, 2019.

* cited by examiner

SCREEN FRAME AND ADAPTER FOR UNIVERSAL INSTALLATION WITHIN DIFFERENT SIZED WINDOW/DOOR SOCKETS

CROSS REFERENCES TO RELATED APPLICATIONS

This application claims priority on U.S. Provisional Application Ser. No. 62/777,355, filed on Dec. 10, 2018, the disclosures of which are incorporated herein by reference.

FIELD OF THE INVENTION

The present invention relates to improvements in a removable screen that may be used for windows and doors, and more particularly to an improved screen arrangement that permits installation of the same screen frame within different windows and doors having different socket sizes.

BACKGROUND OF THE INVENTION

Screens used in windows and doors are typically rectangular, and are designed to fit within spaced apart upper and lower sockets formed in the window or door. The spacing between the lower-most extent/depth of the lower socket and the upper-most extent/depth of the upper socket is usually greater than the corresponding extent of the window screen frame, to allow the screen to be first slid within the upper socket, and then be dropped down into the lower socket, being retained in the door or window by being nested within the bottom socket and a portion of the upper socket. The lateral extent of the upper and lower sockets generally match the corresponding lateral extent of the rectangular-shaped frame of the screen, and usually provides for a small clearance therebetween. Similarly, the width of each of the upper and lower sockets corresponds to the width/thickness of the frame of the screen, and also usually provides for a small clearance for the width/thickness of the particular screen frame.

The rectangular shapes of the screen assemblies may vary widely. To accommodate construction of most of the desired size variations, a series of different extruded lengths may be stocked for the sides of the screen frame, and which may be assembled to create a family of different sized/shaped rectangular screens. For example, a family of 14 extruded length parts may be stocked to form a large family of different rectangular screen frames. Because screens are usually colored to match windows, these 14 extruded length parts may also be stocked in 7 different colors, necessitating that 98 different SKU's be stocked to be able to readily construct that family of rectangular shapes in seven colors. (Note, although other screen shapes other than a rectangular shape may be used, they may be custom made).

Moreover, depending upon the overall size of the rectangular-shaped screen, the frame is often manufactured in one of several different thicknesses (e.g., $5/16^{th}$ of an inch, $3/8^{th}$ of an inch, and $7/16^{th}$ of an inch). Where the screen and consequently the frame of the screen is small in size, the thickness used may be, for example, $5/16^{th}$ of an inch. As the screen size and consequently the frame of the screen increases, the thickness used may instead be $3/8^{th}$ of an inch, and for larger sized frames/screens, the thickness of the frame used may be $7/8^{th}$ of an inch.

Therefore, stocking of the 14 extruded length parts in seven different colors (i.e., 98 different SKU's) and in three different thicknesses (5/16", 3/8" and 7/16") requires stocking of 294 SKU's (i.e., 3×98) to be able to form that extended family of rectangular shapes with the various different frame colors and thicknesses. So stocking of the 14 extruded length parts for the seven colors is tripled (i.e., from 98 SKU's to 298 SKU's) when the necessary parts are furthermore stocked to be able to accommodate forming the frames in three different thicknesses (e.g., $5/16^{th}$ of an inch, $3/8^{th}$ of an inch, and $7/16^{th}$ of an inch).

Therefore, the present invention was conceived to eliminate the requirement to stock an additional 196 SKU's, to be able to accommodate forming that family of frames in all seven colors and all three different thicknesses. This provides a significant cost savings, requiring production of fewer different parts and fewer total numbers of parts, and requires a smaller warehouse footprint for stocking of those parts.

OBJECTS OF THE INVENTION

It is an object of the invention to provide a frame for a screen assembly that may be universally used in similarly shaped doors and windows.

It is another object of the invention to provide a particularly formed frame for a screen assembly and also a plurality of particularly formed adapters for use on that frame to form a family of different screen assemblies that may be used in different doors and windows having different socket widths.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In accordance with at least one embodiment of the present invention, a combination frame and adapter for a screen assembly are disclosed, and may be used in installing the screen assembly into different windows or doors having different socket widths.

A first adapter may be formed to include a base portion; a stem portion, and a bulb portion. The stem portion may be configured to extend away from the base portion to a distal end of the stem portion; and the bulb portion may be configured to extend a distance away from the distal end of the stem portion. A second adapter may be similarly formed, but the bulb portion of the second adapter may be configured to extend away from the distal end of its stem portion a second distance, being a greater distance than the first distance that the bulb portion of the first adapter extends.

The frame may be formed to have a width/thickness of roughly $5/16^{th}$ of an inch. The frame may also be formed to include one or more recesses on a first side member of the frame, where each recess may be configured to slidably receive one of the adapters, and the frame may also be formed to include one or more recesses on a second side member of the frame, each being similarly configured to also slidably receive one of the adapters.

Therefore, the frame being so formed with the $5/16^{th}$ of an inch width/thickness is sized to fit within the socket of the doors and windows where the socket width is roughly $5/16^{th}$ of an inch. For other doors and windows with a socket that is formed to receive a screen frame that is roughly $3/8^{th}$ of an inch thick, adapters of the first type/size may be installed in each of the recesses in the $5/15^{th}$ inch thick frame, and a distance that a protruding bulb portion of the first adapter in combination with the $5/16^{th}$ of an inch thickness serves to form a $3/8^{th}$ inch thickness for securing the frame in those corresponding sockets. Similarly, where the socket of yet other doors and windows is formed to receive a screen frame that is roughly $7/16^{th}$ of an inch thick, adapters of a second type/size may be installed in each of the recesses in the frame, and the protruding distance of the bulb portion of the second adapter in combination with the $5/16^{th}$ of an inch thick frame serves to form a $7/16^{th}$ inch thickness for securing the frame in those sockets.

BRIEF DESCRIPTION OF THE DRAWINGS

The description of the various example embodiments is explained in conjunction with appended drawings, in which.

DETAILED DESCRIPTION OF THE INVENTION

Figure 2:
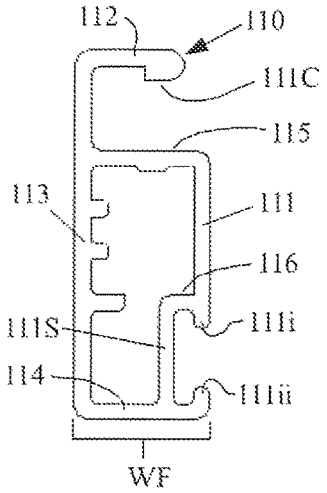
FIG. 2 illustrates an end view through the portion of a frame for a screen as shown in FIG. 1.

As used throughout this specification, the word "may" is used in a permissive sense (i.e., meaning having the potential to), rather than a mandatory sense (i.e., meaning must), as more than one embodiment of the invention may be disclosed herein. Similarly, the words "include", "including", and "includes" mean including but not limited to.

The phrases "at least one", "one or more", and "and/or" may be open-ended expressions that are both conjunctive and disjunctive in operation. For example, each of the expressions "at least one of A. B and C". "one or more of A, B. and C", and "A, B, and/or C" herein means all of the following possible combinations: A alone; or B alone; or C alone; or A and B together; or A and C together; or B and C together; or A. B and C together.

Also, the disclosures of all patents, published patent applications, and non-patent literature cited within this document are incorporated herein in their entirety by reference. However, it is noted that citing herein of any patents, published patent applications, and non-patent literature is not an admission as to any of those references constituting prior art with respect to the disclosed and/or claimed apparatus/method.

Furthermore, the reference throughout this specification to "one embodiment" or "an embodiment" means that a particular feature, structure or characteristic described in connection therewith is included in at least that one particular embodiment. Thus, the appearances of the phrases "in one embodiment" or "in an embodiment" in various places throughout this specification are not necessarily all referring to the same embodiment. Additionally, the described features, advantages, and characteristics of any particular embodiment disclosed herein may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of a multiplicity of such individual tolerances.

Any use of a friction fit (i.e., an interface fit) between two mating parts described herein indicates that the opening (e.g., a hole) is smaller than the part received therein (e.g., a shaft), which may be a slight interference in one embodiment in the range of 0.0001 inches to 0.0003 inches, or an interference of 0.0003 inches to 0.0007 inches in another embodiment, or an interference of 0.0007 inches to 0.0010 inches in yet another embodiment, or a combination of such ranges. Other values for the interference may also be used in different configurations (see e.g., "Press Fit Engineering and Design Calculator," available at: www.engineersedge.com/calculators/machine-design/press-fit/press-fit-calculator.htm).

Any described use of a clearance fit indicates that the opening (e.g., a hole) is larger than the part received therein (e.g., a shaft), enabling the two parts to move (e.g. to slide and/or rotate) when assembled, where the gap between the opening and the part may depend upon the size of the part and the type of clearance fit—i.e., loose running, free running, easy running, close running, and sliding (e.g., for a 0.1250 inch shaft diameter the opening may be 0.1285 inches for a close running fit, and may be 0.1360 inches for a free running fit; for a 0.5000 inch diameter shaft the opening may be 0.5156 inches for a close running fit and may be 0.5312 inches for a free running fit). Other clearance amounts are used for other clearance types. See "Engineering Fit" at: https://en.wikipedia.org/wiki/Engineering_fit; and "Three General Types of Fit," available at www.mm-to.org/dclark/Reports/Encoder%20Upgrade/fittolerences%20%5BRead-Only %5D.pdf.

It is further noted that any use herein of relative terms such as "top," "bottom," "upper," "lower," "vertical." and "horizontal" are merely intended to be descriptive for the reader, based on the depiction of those features within the figures for one particular position of the device, and such terms are not intended to limit the orientation with which the device of the present invention may be utilized.

In accordance with at least one embodiment of the present invention, a frame 105 for a screen assembly 100 (e.g., FIG. 10) may be particularly formed so that the screen assembly may be installed into various different windows or doors having different socket widths, when used, for some of those cases, in combination with a particularly formed first adapter 150, or a second particularly formed adapter 170.

Figure 1:
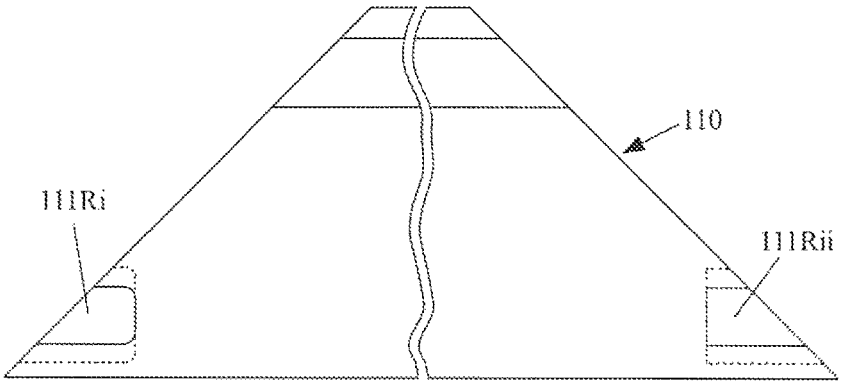
FIG. 1 illustrates a front view of a portion of a frame for a screen formed in accordance with the present invention.
Figure 1A:
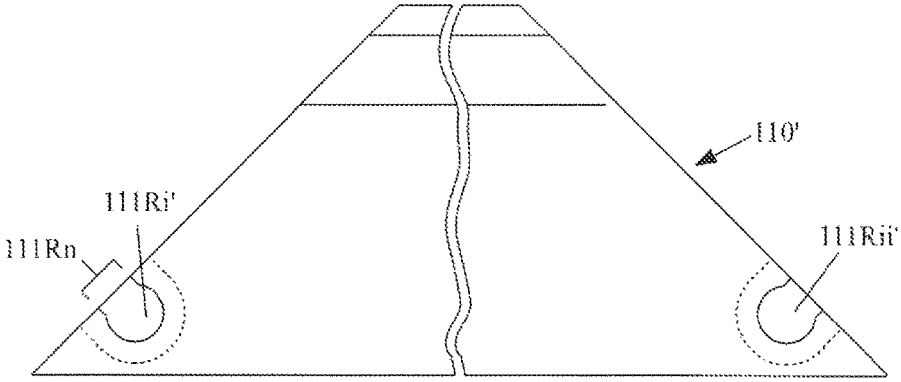
FIG. 1A illustrates a front view of a portion of a frame for a screen formed in accordance with another embodiment of the present invention.

The frame 105 (e.g., FIG. 9) of a screen assembly 100 may have at least two of its four sides constructed using a particularly formed elongated member 110, which is shown in FIGS. 1-2. The elongated member 110 may have a generally rectangular cross-sectional shape, as seen in FIG. 2, that may be formed by a first wall 111, a second wall 112, a third wall 113, and a fourth wall 114. The first wall 111 and the third wall 113 may be substantially parallel, and may be spaced apart a particular width/distance WF to permit it to be installed into a first (smaller) socket size that is typically used in a window or door (e.g., $5/16^{th}$ of an inch). Note, although the frame 105 is illustrated as it may be when formed through an extrusion or casting process, it may also be made through any other suitable manufacturing process, including by welding, machining, assembling parts with the use of mechanical fasteners, etc.

The first wall 111 may have an opening formed therein proximate to a first side of the member, with the opening defining an interior cavity surface 111C, which opening and cavity may extend along the entire length of the elongated member 110. A transverse wall 115 may extend from one side of the opening in the first wall 111 to the third wall 113, to shorten the extent of the cavity, so as to be sized to receive a spline 106 therein in a friction fit, to secure the end of a mesh material 107 to the frame of the screen assembly 100 (see e.g., FIG. 10).

In one embodiment, as seen in FIG. 2, the first wall 111 may also have a particularly shaped recess formed proximate to a second side of the member, and may have a first such recess 111Ri formed at a first end of the elongated member 110, and a second such recess 111Rii formed at a second end of the elongated member. (It is noted that in other embodiments, the recess may be formed on other portions of the elongated member 110). Also, in one embodiment the recess may be generally T-shaped. In another embodiment the recess may be generally V-shaped, and in other embodiments other shapes may be used for the recess, which other shapes may similarly provide for retention of a correspondingly shaped adapter, which is discussed hereinafter.

Figure 11:
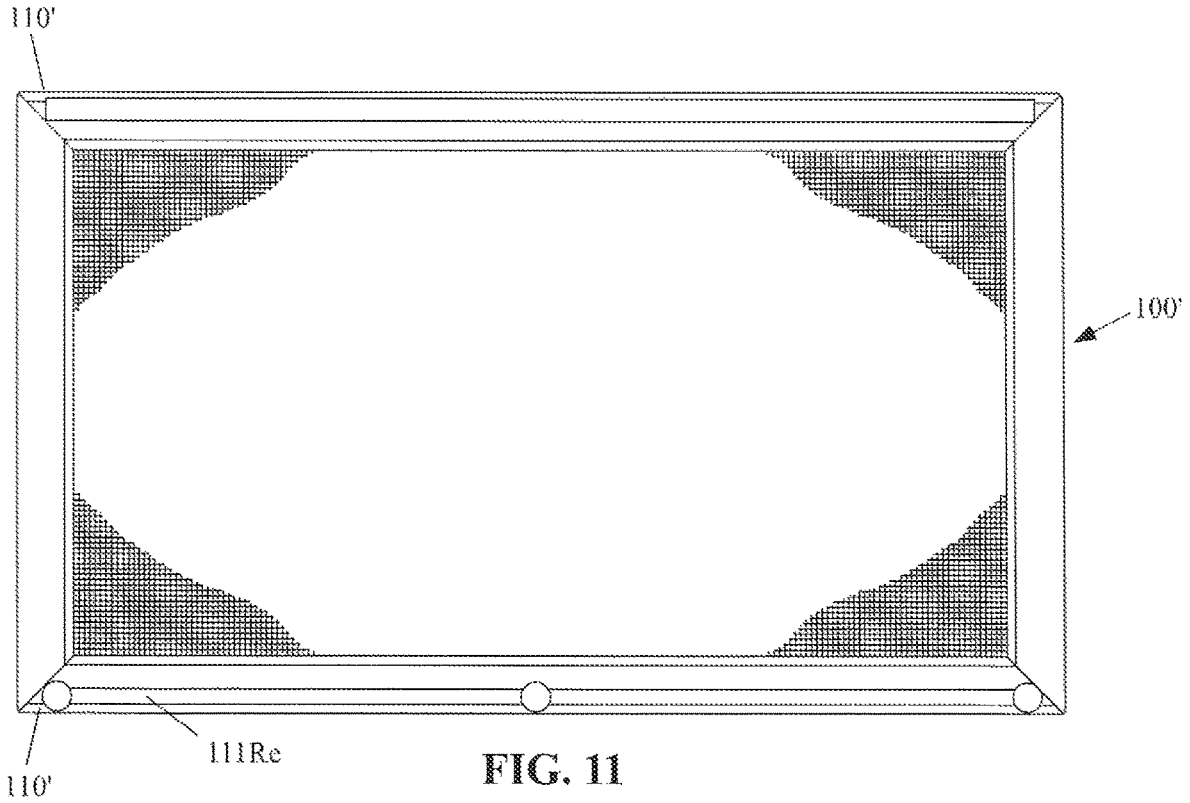
FIG. 11 is a front view showing a screen assembly formed in accordance with the present invention, having one elongated adapter installed on the upper side member of the frame, and having three small adapters positioned on the lower side member of the frame.

Each recess may extend a short distance along the length of the elongated member 110, as seen in FIG. 2, or, as shown for the elongated member 110' in FIG. 11, a single recess 111Re may extend along the entire length of the elongated member.

As seen in FIG. 2, the recess 111Ri may be formed by an opening in the first wall 111, to create two protruding flange ends 111*i* and 111*ii*. In one embodiment the adapter may be supported by these two flange ends 111*i* and 111*ii*, and the recess may extend all the way to the third wall 113. In another embodiment a secondary wall 111S may be formed to reduce the depth of the recess, to enable use of less material in forming the adapter. The secondary wall 111S may be formed to be generally parallel to the first wall 111, and a first one of its ends may be formed to connect to the fourth wall 114 and a second one of its ends may connect to a wall 116 that may extend transversely from the first wall 111, to form the shallow T-shaped recess shown in the cross-sectional view of FIG. 2. Note that the recess may alternatively be formed, as shown in FIG. 2A for the elongated member 110", to be disposed normal to the angled end of the elongated member, and the recesses 111Ri' and 111Rii' may furthermore have a necked down portion 111Rn at the angled end of the elongated member to assist in retaining the adapter therein until the four sides of the screen are assembled and secured together to form the frame 105. Adhesive may additionally or alternatively be used for that purpose. The recesses 111Ri' and 111Rii' may also be completely covered by the adapters discussed hereinafter.

Figure 3:
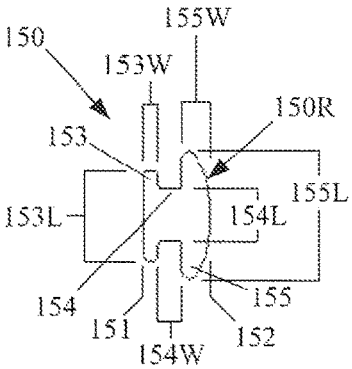
FIG. 3 is an end view of a first adapter of the present invention.

The first adapter 150 is shown in the end view of FIG. 3. The first adapter 150 may extend from a first end 151 to a second end 152, and may be formed to have a base portion 153 proximate to the first end 151, a stem portion 154, and a bulb portion 155 proximate to the second end 152.

The base portion 153 may have a length 153L that is sized to fit within the recess between the fourth wall 114 and the transverse wall 116, which fit may be a slight clearance fit, or a slight friction fit. The base portion 153 may also have a width 153W that is sized to fit within the recess between the secondary wall 111S and the first wall 111, which fit may also be a slight clearance fit, or a slight friction fit.

The stem portion 154 may be formed to extend away from the base portion 153 to a distal end at which the bulb portion 155 is formed. The stem portion 154 may have a length 154L that is sized to position the flat side of the bulbous portion 155 in close proximity to, or in contact with, the first wall 111. To place the flat side of the bulbous portion 155 in contact with the first wall 111, the length 154L of the stem portion 154 may be the same as, or slightly smaller than, the thickness of the first wall 111. The stem portion 154 may also have a width 154W that is sized to fit between the two protruding flange ends 111*i* and 111*ii*, which fit may also be a slight clearance fit, or a slight friction fit.

Figure 3A:
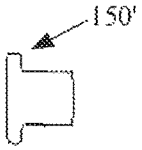
FIG. 3A is an end view of a different version of the first adapter of FIG. 3, being formed without an overhanging rounded bulb portion.

The bulb portion 155 may be formed to extend away from the distal end of the stem portion 154. The bulb portion 155 may preferably have a length 155L that is sized to overhang the two protruding flange ends 111*i* and 111*ii* of the first wall 111. (Note that as shown in FIG. 3A the rounded bulb portion of the adapter 150' may alternatively not be sized to overhang the two protruding flange ends 111*i* and 111*ii* of the first wall 111). The bulb portion 155 may preferably be formed with a radius at its distal end, having a radius 150R, which may assist in installing and removing of the frame from the window or door. The bulb portion 155 may preferably be formed with a width 155W that in combination with the particular width/distance WF between the first wall 111 and the second wall 112 of the frame 110 permits the frame to be installed into a larger socket size than the $5/16^{th}$ of an inch socket. e.g., a $3/8^{th}$ of an inch socket, in which case WF plus 155W is roughly $3/8^{th}$ of an inch.

Figure 4:
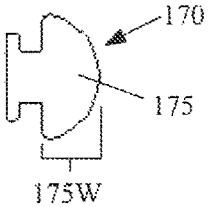
FIG. 4 is an end view of a second adapter of the present invention.

The second adapter 170 is shown in the end view of FIG. 4. The second adapter 170 may be formed substantially the same as the first adapter 150, but may be formed to have a bulb portion 175 that may be formed with a width 155W that in combination with the particular width/distance WF between the exterior surfaces of the first wall 111 and the second wall 112 of the frame 110 permits it to be installed into an even larger socket size than the smaller $3/8^{th}$ of an inch socket. e.g., a $7/16^{th}$ of an inch socket, in which case WF plus 155W is roughly $7/16^{th}$ of an inch.

The first adapter 150 and second adapter 170 may each be made of any suitable materials, including, but not limited to, metal, wood, composite, plastic, rubber, etc. The first adapter 150 and second adapter 170 may each also be formed to any particular color, which may be a color that may match the different colored frames that may be used, or it may be formed of a neutral colored material. In one embodiment, the adapters may be made of polypropylene material. Also, in one embodiment, the adapters may be made of a translucent material so that the adapter may take on the color of the elongated side member into which it is installed.

Figure 6:
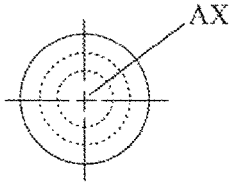
FIG. 6 illustrates a top view of a second embodiment of the adapters of the present invention.

Each of the first adapter 150 and second adapter 170 may be made such that the profile of each of the base portion 153, the stem portion 154, and the bulb portion 155 shown in the respective end views (FIG. 3 and FIG. 4) may be revolved about a central axis Ax (FIG. 6) to form a finished part having the top view shown in FIG. 6, so that those portions of each may be generally cylindrical.

Figure 5:
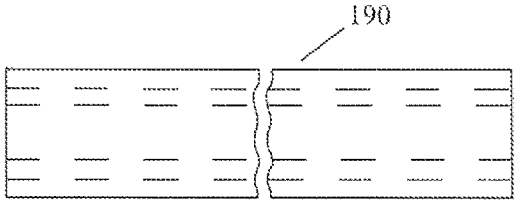
FIG. 5 illustrates a top view of a first embodiment of the adapters of the present invention.

Alternatively, each of the first adapter 150 and second adapter 170 may be made such that the profile of each of the base portion 153, the stem portion 154, and the bulb portion 155 shown in the respective end views (FIG. 3 and FIG. 4) are of an elongated finished part such as the one shown in FIG. 5. In at least this embodiment, the material used should be flexible enough that it can be wound and stored on a reel.

Figure 7:
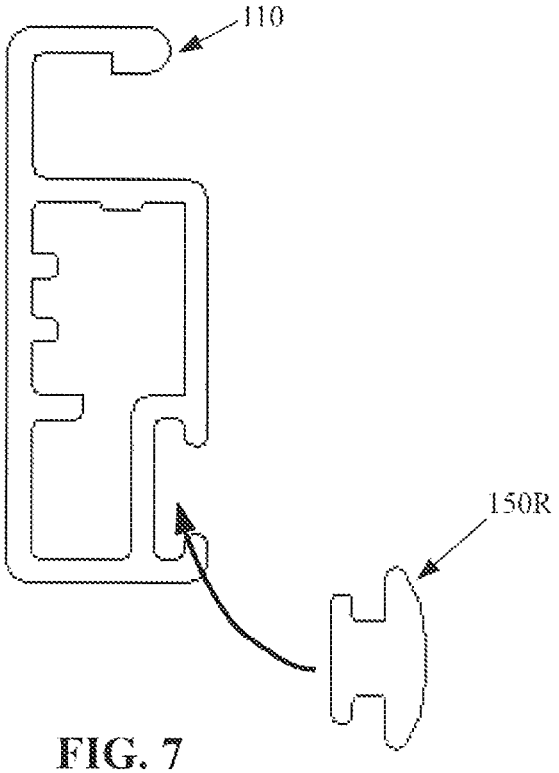
FIG. 7 shows the adapter of FIG. 3 prior to being received in the recess of the frame portion shown in FIG. 3.
Figure 8:
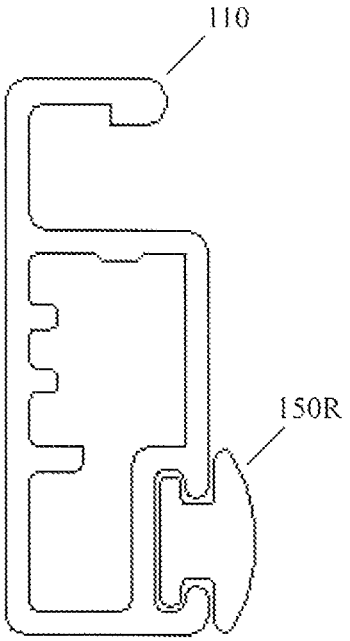
FIG. 8 shows the adapter of FIG. 3 after being received in the recess of the frame portion shown in FIG. 3.
Figure 9:
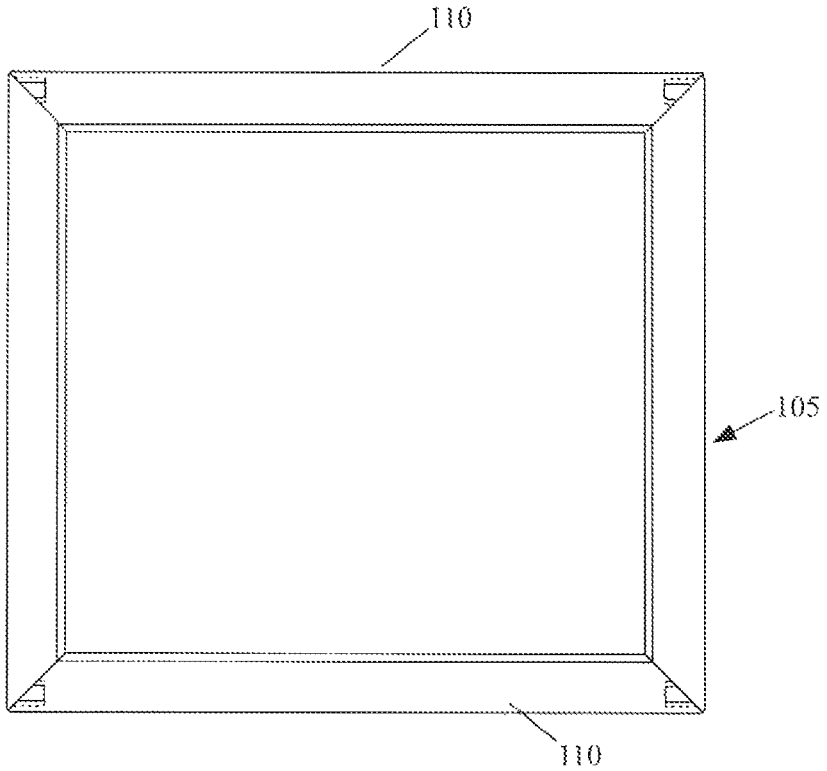
FIG. 9 is a front view of a frame for a screen assembly formed in accordance with the present invention.
Figure 10:
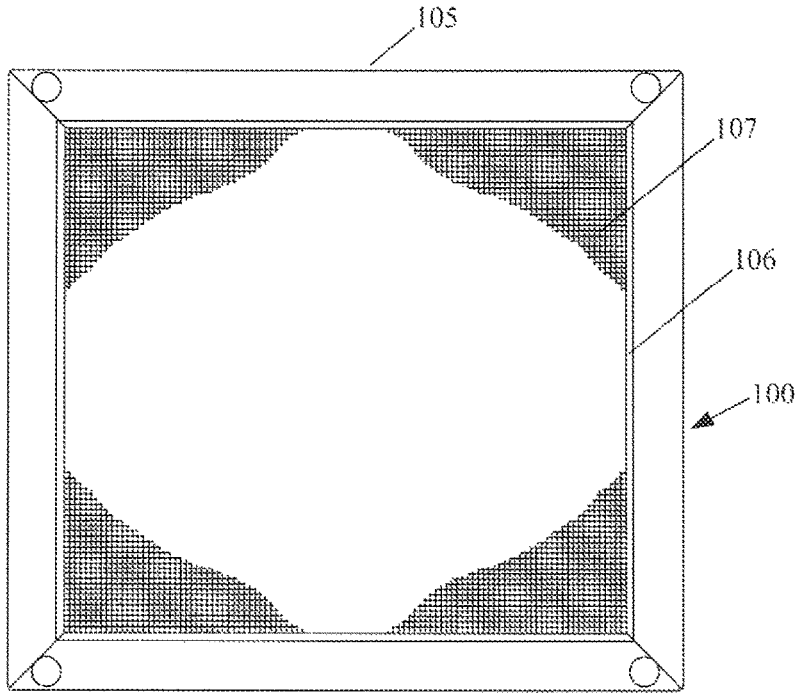
FIG. 10 is a front view showing a screen assembly formed in accordance with the present invention, having two adapters positioned on each of the upper sand lower side members of the frame.

For the frame 110 shown in FIG. 9, each of the recesses of the two elongated members 110 may slidably receive an adapter therein (see FIGS. 7-8), prior to the final joining of the sides of the frame, which may appear as shown in FIG. 10. Depending upon the shape of the recess that is formed, a portion of it may still be visible after the adapter is installed therein, as may be seen in the bottom of the frame 110' of the screen assembly 100' shown in FIG. 11.

Where a screen assembly may be fairly small is size (e.g., having a pair of sides each being less than about 18 inches in length), the frame may be formed with recesses that may be proximate to each corner, so that each of a first recess, a second recess, a third recess, and a fourth recess may respectively position a first adapter, a second adapter, a third adapter, and a fourth adapter proximate to the first corner, the second corner, the third corner, and the fourth corner of the frame.

Where a screen assembly may be larger in size (e.g., having a pair of sides each being greater than about 18 inches in length), the frame may be formed with the recess that may extend across the entire length of the elongated member, as discussed hereinabove (e.g., recess 111Re). Thus, the frame may receive a first adapter, a second adapter, and a third adapter (or more such adapters) in each recess on each of the two elongated members (see the bottom of the screen assembly in FIG. 11), or may alternatively receive only a single elongated adapter (see the top of the screen assembly in FIG. 1).

Figure 12:
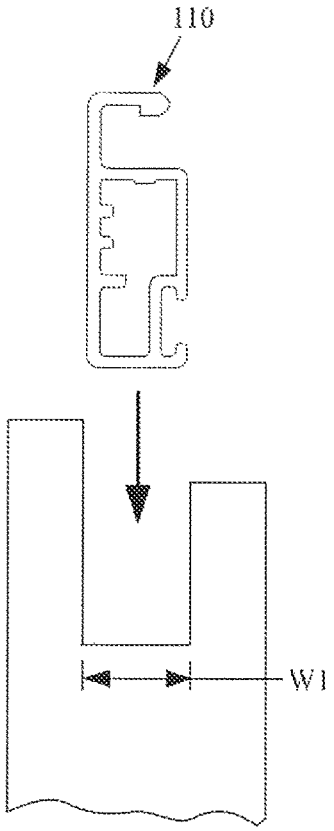
FIG. 12 shows the frame portion of FIG. 2 prior to being received in a socket of a first window or door.
Figure 12A:
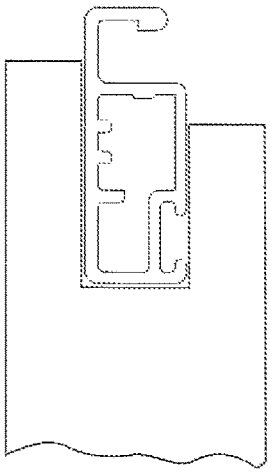
FIG. 12A shows the frame portion of FIG. 2 after being received in the socket of the first window or door.

The use of just the frame 110 in a socket of a door or window having a socket width W1 (e.g., $5/16^{th}$ of an inch) without the use of any adapters secured thereto is shown in FIG. 12 and FIG. 12A, and the frame may be sized to provide a clearance fit or a slight friction fit with the socket.

Figure 13:
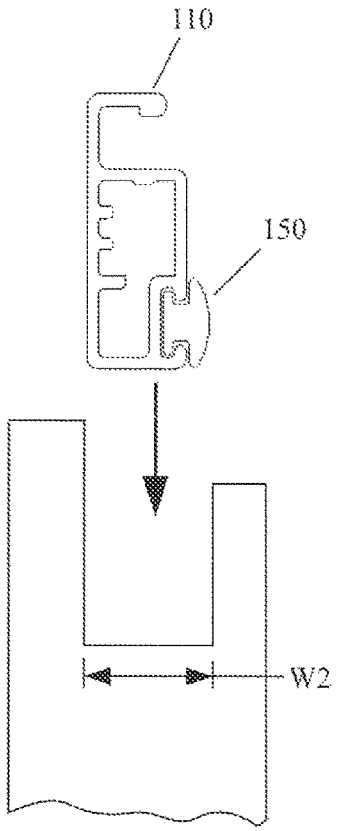
FIG. 13 shows the frame portion of FIG. 2 with the first adapter of FIG. 3 mounted thereto, prior to being received in a socket of a second window or door.
Figure 13A:
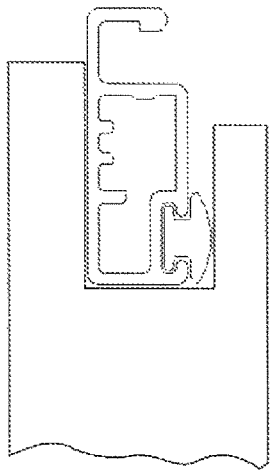
FIG. 13A shows the frame portion of FIG. 2 with the first adapter of FIG. 3 mounted thereto, after being received in the socket of the second window or door.

The use of the frame 110 in a socket of a door or window having a socket width W2 (e.g., $3/8^{th}$ of an inch) with the use of adapters 150 secured thereto is shown in FIG. 13 and FIG. 13A, and the combination of the frame and adapters may provide a slight clearance fit or a slight friction fit with the socket.

Figure 14:
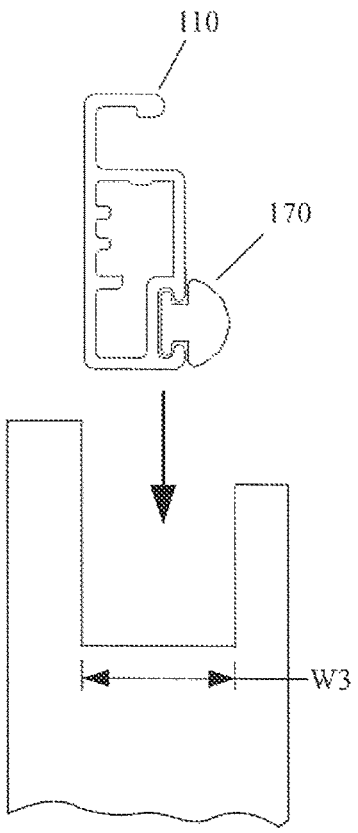
FIG. 14 shows the frame portion of FIG. 2 with the second adapter of FIG. 4 mounted thereto, prior to being received in a socket of a third window or door.
Figure 14A:
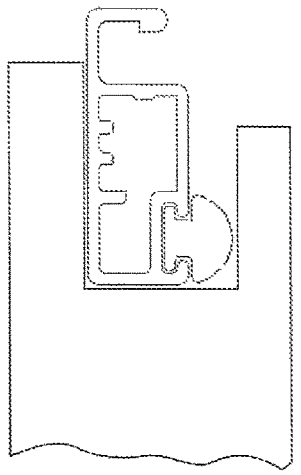
FIG. 14A shows the frame portion of FIG. 2 with the second adapter of FIG. 4 mounted thereto, after being received in a socket of a third window or door.

The use of the frame 110 in a socket of a door or window having a socket width W3 (e.g., $7/16^{th}$ of an inch) with the use of adapters 175 secured thereto is shown in FIG. 14 and FIG. 14A, and the combination frame and adapter may similarly provide a slight clearance fit or a slight friction fit with the socket.

In an alternative embodiment, an adapter may be used on a frame without any recesses formed therein, where the adapter only includes the bulb portion, and which adapter may be secured to the frame using adhesive.

While illustrative implementations of one or more embodiments of the present invention are provided hereinabove, those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A combination frame and adapter for a screen assembly, for use in enabling universal installation of the screen assembly into different windows or doors having different socket widths;

wherein said adapter comprises:

a base portion;

a stem portion, said stem portion being substantially cylindrical and being configured to extend away from said base portion to a distal end of said stem portion; and a bulb portion, said bulb portion configured to extend away from said distal end of said stem portion, and be symmetrically formed with respect to an axis of said cylindrical stem portion;

wherein said frame comprises:

at least one opening on a first portion of said frame each configured to form a recess and two protruding flange ends, each said at least one opening being configured to slidably receive a respective said adapter, with said base portion positioned within said recess, with said cylindrical stem positioned between said two protruding flange ends, and with said bulb portion positioned and configured to overhang said two protruding flange ends and to protrude from a first side of said frame; and at least one opening on a second portion of said frame each configured to form a recess and two protruding flange ends, each said at least one opening in said second portion of said frame being configured to slidably and correspondingly receive a respective said adapter, each with said bulb portion positioned to protrude from said first side of said frame;

wherein said frame comprises a width configured to be received in a first door/window socket having a first socket width; and wherein each said bulb portion protrudes a distance away from said first side of said frame when said respective adapters are installed in said frame, and wherein said width of said frame and said protruding distance of each said bulb portion are configured to be received in a second door/window socket having a second socket width.

2. The combination frame and adapter for a screen assembly according to claim 1, wherein said at least one opening on said first portion of said frame comprises a first opening and a second opening configured to respectively receive said first adapter and a third said adapter; and wherein said at least one opening on said second portion of said frame comprises a third opening and a fourth opening configured to respectively receive said second adapter and a fourth said adapter.

3. The combination frame and adapter for a screen assembly according to claim 2, wherein said frame is rectangular shaped having a first corner, a second corner, a third corner, and a fourth corner; and wherein each of said first opening, said second opening, said third opening, and said fourth opening are respectively positioned proximate to said first corner, said second corner, said third corner, and said fourth corner, to respectively position each of said first adapter, said third adapter, said second adapter, and said fourth adapter proximate to said first corner, said second corner, said third corner, and said fourth corner.

4. The combination frame and adapter for a screen assembly according to claim 1, wherein said bulb portion comprises at least a portion of a hemispherical surface.

5. The combination frame and adapter for a screen assembly according to claim 1, wherein said protruding distance of each said bulb portion and said width of said frame are configured to be received in the second socket width in a friction fit.

6. The combination frame and adapter for a screen assembly according to claim 1, wherein said protruding distance of each said bulb portion and said width of said frame are configured to be received in the second socket width in a clearance fit.

7. A combination frame and adapter for a screen assembly, for use in enabling universal installation of the screen assembly into different windows or doors having different socket widths;

wherein said adapter comprises:

a base portion;

a stem portion, said stem portion being substantially cylindrical and being configured to extend away from said base portion to a distal end of said stem portion; and a bulb portion, said bulb portion configured to extend away from said distal end of said stem portion, and be symmetrically formed with respect to an axis of said cylindrical stem portion;

wherein said frame comprises at least one opening on a first portion of said frame being configured to slidably receive a first said adapter, and at least one opening on a second portion of said frame being configured to slidably receive a second said adapter;

wherein said frame comprises a width configured to be received in a first door/window socket having a first socket width; and wherein each said bulb portion protrudes a distance away from a first side of said frame when said adapters are installed in said frame, and wherein said width of said frame and said protruding distance of each said bulb are configured to be received in a second door/window socket having a second socket width.

8. The combination frame and adapter for a screen assembly according to claim 7, wherein said at least one opening on said first portion of said frame comprises a first opening and a second opening configured to respectively receive said first adapter and a third said adapter, and wherein said at least one opening on said second portion of said frame comprises a third opening and a fourth opening configured to respectively receive said second adapter and a fourth said adapter.

9. The combination frame and adapter for a screen assembly according to claim 8, wherein said frame is rectangular shaped having a first corner, a second corner, a third corner, and a fourth corner; and wherein each of said first opening, said second opening, said third opening, and said fourth opening are respectively positioned proximate to said first corner, said second corner, said third corner, and said fourth corner, to respectively position each of said first adapter, said third adapter, said second adapter, and said fourth adapter proximate to said first corner, said second corner, said third corner, and said fourth corner.

10. The combination frame and adapter for a screen assembly according to claim 7, wherein said bulb portion comprises at least a portion of a hemispherical surface.

11. The combination frame and adapter for a screen assembly according to claim 7, wherein said protruding distance of each said bulb portion and said width of said frame are configured to be received in the second socket width in a friction fit.

12. The combination frame and adapter for a screen assembly according to claim 7, wherein said protruding distance of each said bulb portion and said width of said frame are configured to be received in the second socket width in a clearance fit.

* * * * *